United States Patent [19]

Katsenes

[11] 4,156,979

[45] Jun. 5, 1979

[54] GUN RECOIL DAMPER

[76] Inventor: Philip K. Katsenes, 630 Idaho Ave., Apt. 201, Santa Monica, Calif. 90403

[21] Appl. No.: 881,588

[22] Filed: Feb. 27, 1978

[51] Int. Cl.[2] ..... F41C 27/00

[52] U.S. Cl. ..... 42/1 V; 89/198

[58] Field of Search ..... 42/1 V; 89/198

[56] References Cited

U.S. PATENT DOCUMENTS

| | | | |
|---|---|---|---|
| 2,679,192 | 5/1954 | Seeley et al. | 42/1 V |
| 3,018,694 | 1/1962 | Browning | 89/198 |
| 4,088,057 | 5/1978 | Nasypany | 42/1 V |

*Primary Examiner*—Charles T. Jordan

*Attorney, Agent, or Firm*—William H. Maxwell

[57] ABSTRACT

A damper means for reducing the recoil of a firearm, and comprising a piston operated forwardly by gases drawn through a port along the gun barrel to rebound from a means storing kinetic energy for release rearwardly into the piston mass during the latter part of the firing cycle.

6 Claims, 3 Drawing Figures

GUN RECOIL DAMPER

BACKGROUND

Sporting guns are subjected to heavy charges, i.e. magnum loads etc., and the recoil is commensurately great. Needless to say, continuous shooting with these heavy loads is discomforting to the person firing the gun, namely the impact that must be sustained by the shoulder of the person when the butt of the stock impacts thereagainst. Accordingly, it is a general object of this invention to provide damper means by which recoil is reduced, it being the shotgun with which this invention is primarily concerned.

Heretofore, the recoil of sporting guns, namely shotguns, has been controlled generally by weight of the firearm. However, it is highly desirable that such guns be lightweight, and as a result heavy charges have their effect of increasing the recoil to uncomfortable limits. Various anti-recoil concepts have been proposed but none of which have been particularly desirable, gas discharge and/or the cumbersomeness of added weight being a problem.

The burning rate of the gun powder also has its effect, and a peculiarity of recoil is its greater magnitude at the end of the firing cycle, as and when the shot leaves the barrel. This does not nullify the build-up of recoil as the shot is accelerated, but it has been observed that this phenomenon does exist. Therefore, it is an object of this invention to provide recoil means that is effective during the latter part of the firing cycle in order to reduce that portion of the recoil which is known to be of the greater magnitude.

In accordance with the present invention, an inertia damper is shifted by gas pressure during the early portion of the firing cycle, to be returned by a buffer spring during the latter portion of the firing cycle. The pressure curve of the burning explosive and the acceleration of the projectile or shot are taken into consideration herein, and also that these forces are imposed from beyond the end of the gun barrel, or from the muzzle. It is an object therefore, to provide a damper means that advantageously employs the build-up and drop-off of gas pressures within the gun barrel, to shift an inertia weight forwardly at a relatively slow rate as gas pressure builds up and to release the same for return by the buffer spring during the latter portion of the firing cycle, so as to reduce the recoil. In practice, but a small portion of the explosive gas is taken for this operation.

SUMMARY OF INVENTION

This invention relates to sporting guns, and particularly shotguns of light weight and which are chambered for heavy charges. It is an object to avoid encumbering the gun configuration, and to avoid any obnoxious discharge of gases. Accordingly, this recoil damper is shown incorporated in an ordinary single barrel shotgun, for simplicity; a sporting gun wherein the breech breaks open at the receiver 10 so as to expose the chamber 11 for loading. The receiver 10 is carried by a stock 13 and the barrel 12 projects from the receiver with a forestock or grip 14 that is removable for breakdown of the gun; and all of which varies in detail with different guns. In accordance with this invention, the recoil damper X is accommodated alongside the gun receiver 10 and barrel 12, extending forwardly from the breech and preferably housed within the grip 14. A feature is the gas take-off saddle 15 that is selectively positioned to momentarily receive gas from the barrel after there is sufficient build-up of pressure and after initial acceleration of the load has occurred, thereby to shift an inertia weight forwardly against a buffer. As shown, the damper means X involves a cylinder C, an inertia weight W and a buffer means B, the device being operated by gas pressure introduced and exhausted through the aforesaid gas take-off saddle 15.

DRAWINGS

The various objects and features of this invention will be fully understood from the following detailed description of the typical preferred forms and applications thereof, throughout which description reference is made to the accompanying drawings, in which.

PREFERRED EMBODIMENT

Figure 1:
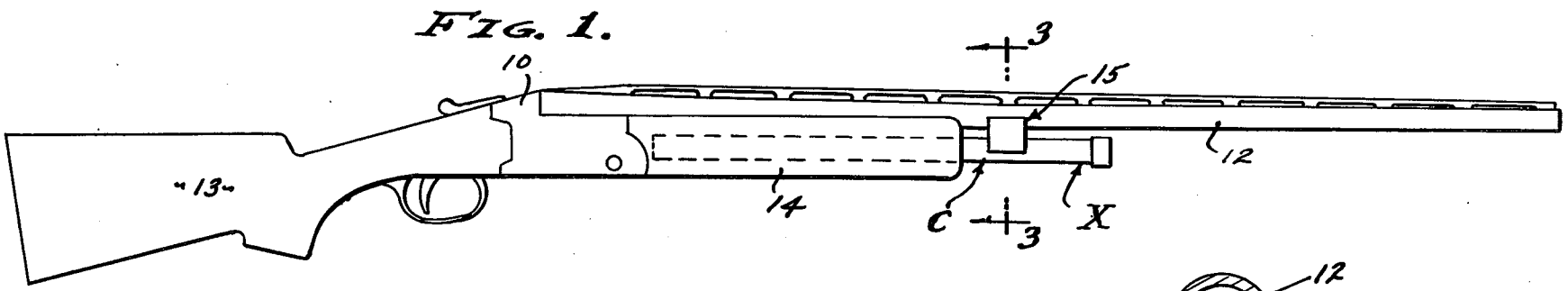
FIG. 1 is a side view of a firearm incorporating the gun recoil damper of the present invention.
Figure 3:
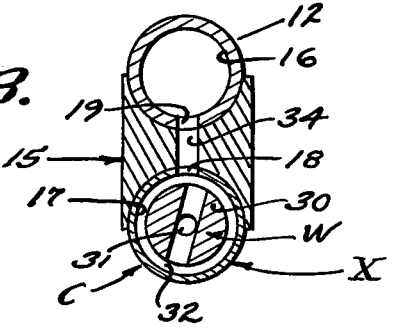
Figure 2:
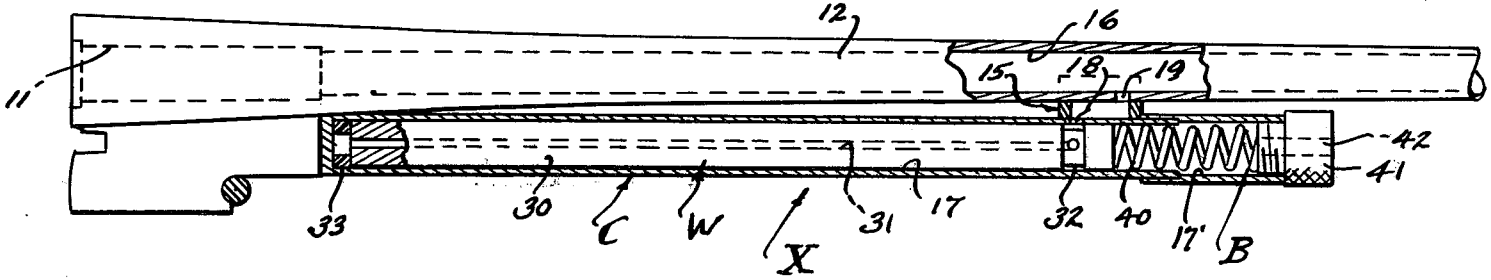
FIG. 2 is an enlarged longitudinal view of the gun barrel with the gun recoil damper attached thereto. And, FIG. 3 is an enlarged transverse sectional view taken as indicated by line 3—3 on FIG. 1.

Referring now to the drawings, the damper means X lies alongside the receiver 10 and the barrel 12 which has the cartridge chamber 11 and a bore 16 continuing therefrom to open at the muzzle. The cylinder C is radially offset from the receiver and barrel, and disposed on an axis parallel to the barrel axis. That is, the cylinder C is juxtaposed to the barrel 12, and in practice it extends forwardly to be exposed at the front end of the forestock or grip 14. The cylinder diameter is approximately the same as the barrel diameter, as shown, having an inner diameter bore 17 closed at its rear end and closed at its front end by removable buffer means B. As will be described, the gas take-off saddle is positioned intermediate the ends of the cylinder C where it has open communication with the gun bore 16 through ports 18 and 19 positioned as required longitudinally of the cylinder C and barrel 12 respectively.

Referring now to the inertia weight W, it is a normally retracted piston body 30 that is adapted to shift forwardly into momentary engagement with the buffer means B from which it rebounds during the latter part of the firing cycle, it being a primary objective to coordinate the time period of this rebound with the aforesaid greater recoil. As shown, the piston body 30 is an elongated right cylinder fitted to slide free in the bore 17, with substantial freedom to move forwardly. A feature of the piston body 30 is its open communication with port 18 when at rest in its normally retracted position, there being a fluid passage 31 extending from a circumferential channel 32 to the rearmost end of said piston. The passage 31 is of small diameter, whereby the piston body 30 is of substantial weight, however the length of the channel provides a chamber within which explosive gases under pressure will expand and issue into the cylinder bore 17 at the rear of the piston body 30, ahead of a buffer ring 33. It will be seen that forward movement of the piston body 30 closes the port 18 after which the charge of gases that enters through the passage 31 expands so as to cause continued forward movement of said piston body. The channeled forward end of the piston body 30 operates into a counterbore 17' at the forward end of the bore 17, in order to relieve the operating pressure vented to atmosphere through means B, and so as to enable a free return stroke.

The aforementioned gas take-off saddle 15 provides a passage 34 extending openly between the ports 18 and 19, so that the explosive gases enter into the cylinder C in proper timed relation to the firing cycle. Generally, the port 19 is located intermediate the ends of the gun barrel 12, and it passes explosive gases through passage 34 and to port 18, and then through channel 32 and passage 31; commensurate with an amount thereof required to force the piston body 30 forwardly in order to be returned by the buffer means B in said timed relation to occurence of the greater recoil at the end of the firing cycle. As shown, the saddle 15 is positioned approximately midway along the gun barrel and so as to receive explosive gases through port 19 at about the maximum build-up of pressure thereof in the bore 16, after the load and wad has passed the shot thereover.

Referring now to the buffer means B it is a spring means or the like that compresses with forward movement of the piston body 30, and which depresses the piston body back to its normally retracted position. As shown, there is a compression spring 40 secured by a plug 41 that closes the front end of the cylinder C, a spring that is compressible during the time interval during travel of the load fired through the barrel 12, and which is depressible during the latter part of the firing cycle during the time period as and when the load leaves the muzzle. The plug 41 is vented at 42 for release of gas pressure and so as to enable free return stroke of the piston body.

Accordingly, the piston body 30 moves forwardly commensurate with a force taken from the explosive charge that accelerates the load, simultaneously accelerating the piston body forwardly; all without altering the effect of the normal recoil during transit of the load through the barrel. However, compression of spring 40 has its effect of subtracting from recoil, and during the latter part of the firing cycle when the normally greater recoil would take place the kinetic energy released by the buffer spring 40 subtracts from said recoil. It is to be understood that the parts and elements involved are proportioned to each gun design and loads for which they are chambered. As a result of its operation, this damper substantially reduces the recoil, the remainder of which is ultimately transferred through the stock and to the shoulder of the person firing the gun.

Having described only a typical preferred form and application of my invention, I do not wish to be limited or restricted to the specific details herein set forth, but wish to reserve to myself any modifications or variations that may appear to those skilled in the art as set forth within the limits of the following claims.

I claim:

1. A recoil damper operable when a load leaves the muzzle of a gun barrel, and including; a cylinder juxtaposed to and on an axis parallel with the gun barrel axis, the rear end of the cylinder being closed, there being ports opening into the cylinder and gun barrel intermediate their ends respectively and with an open passage therebetween, an inertial piston body slideable in the cylinder from a normally retracted rearmost position, there being a passage through the piston body and opening therefrom through a circumferential channel aligned with the cylinder port when the piston body is retracted, forward movement of the piston body closing the cylinder port for subsequent expansion of gases passed thereby, and a damper means carried by the front of the cylinder yieldingly resisting forward movement of the piston body and returning the same to its normally retracted rearmost position after the gun is fired.

2. The recoil damper for a gun as set forth in claim 1, wherein the passage through the piston body opens laterally therefrom into the cylinder port when normally retracted, and wherein the cylinder is counterbored at its front end portion receiving the piston body and exposing the lateral passage and open to atmosphere.

3. The recoil damper for a gun as set forth in claim 1, wherein the cylinder is counterbored at its front end portion receiving the piston body and exposing the channel therein and open to atmosphere.

4. The recoil damper for a gun as set forth in claim 1, wherein a saddle extends between the damper cylinder and gun barrel and in which the passage extends between the ports opening into said cylinder and said barrel respectively, and wherein the cylinder is counterbored at its front end portion receiving the piston body and exposing the channel therein and open to atmosphere.

5. The recoil damper for a gun as set forth in claim 1, wherein the gun has a forestock hand grip underlying the gun barrel and the damper cylinder housed therewithin, wherein a saddle extends between the damper cylinder and gun barrel and in which the passage extends between the ports opening into said cylinder and said barrel respectively, wherein the passage through the piston body opens therefrom through a circumferential channel aligned with the cylinder port when the piston body is retracted, and wherein the cylinder is counterbored at its front end portion receiving the piston body and exposing the channel therein and open to atmosphere, and wherein the buffer means is a compression spring that absorbs energy from the forwardly moving piston body during the early portion of the firing cycle and that returns said energy to the piston body during the latter portion of the firing cycle.

6. The recoil damper for a gun as set forth in claim 1, wherein the passage through the piston body opens laterally therefrom into the cylinder port when normally retracted, and wherein the cylinder is counterbored at its front end portion receiving the piston body and exposing the lateral passage and open forwardly to atmosphere through the damper means.

* * * * *